US006158465A

United States Patent [19]

Lambert et al.

[11] Patent Number: 6,158,465

[45] Date of Patent: Dec. 12, 2000

[54] ROTARY VALVE ASSEMBLY FOR ENGINES AND OTHER APPLICATIONS

[76] Inventors: Steven Lambert, 1122 Ontario St., Burbank, Calif. 91505; Michael Lambert, 2032 Highland Ave., Los Angeles, Calif. 90068

[21] Appl. No.: 09/274,989

[22] Filed: Mar. 23, 1999

Related U.S. Application Data

[63] Continuation-in-part of application No. 09/076,287, May 12, 1998, Pat. No. 5,911,203, and a continuation-in-part of application No. 09/236,774, Jan. 26, 1999, Pat. No. 6,029, 617.

[51] Int. Cl.[7] ..... F16K 5/10; F16K 11/078

[52] U.S. Cl. ..... 137/625.16; 137/625.17; 251/207; 251/314

[58] Field of Search ..... 137/625.17, 625.16, 137/625.13, 595; 251/205, 209, 207, 299, 294, 314, 316, 317

[56] References Cited

U.S. PATENT DOCUMENTS

| | | | |
|---|---|---|---|
| 323,568 | 8/1885 | Doherty . | |
| 495,282 | 4/1893 | Vogel . | |
| 630,767 | 8/1899 | Beadle . | |
| 856,569 | 6/1907 | Catlin . | |
| 1,064,476 | 6/1913 | Haskell . | |
| 1,084,410 | 1/1914 | Drennon . | |
| 1,089,779 | 3/1914 | Morgan . | |
| 1,247,156 | 11/1917 | Russell . | |
| 1,291,917 | 1/1919 | Kennedy . | |
| 1,547,253 | 7/1925 | McCarthy . | |
| 2,247,227 | 6/1941 | Findley . | |
| 2,459,973 | 1/1949 | Stevens . | |
| 3,208,719 | 9/1965 | Hulsey | 251/209 |
| 3,515,502 | 6/1970 | Coordes | 137/625.16 |
| 3,822,682 | 7/1974 | Sherwood . | |
| 3,948,286 | 4/1976 | Dunbar et al. . | |
| 4,286,500 | 9/1981 | Stevenson . | |

FOREIGN PATENT DOCUMENTS

| | | | |
|---|---|---|---|
| 162255 | 7/1905 | Germany . | |
| 3338637 | 5/1985 | Germany . | |
| 1406926 | 9/1975 | United Kingdom | 251/209 |
| 1434101 | 5/1976 | United Kingdom | 251/209 |

(List continued on next page.)

*Primary Examiner*—John Rivell
*Assistant Examiner*—Meredith H. Schoenfeld
*Attorney, Agent, or Firm*—Cesari and McKenna

[57] ABSTRACT

A rotary valve assembly includes a housing for positioning on an engine of the piston and cylinder type. The housing includes an intake passage for conducting a working fluid to the cylinder and an exhaust passage for conducting the working fluid from the cylinder. The housing has an internal cavity which intercepts the intake and exhaust passages, which cavity contains a rotary valve member having a window. The window is so positioned that when the member is rotated, it opens and closes the intake and exhaust passages in a periodic manner. The valve assembly may also include a throttle member mounted in the housing parallel to the rotary valve member. The throttle member has a hole which may be positioned opposite the intake passage. The throttle member is movable relative to the axis of the rotary valve member between a first position which places the hole in the throttle means opposite a first portion of the valve member and a second position which places that hole opposite a second portion of the valve member so that when the valve member is rotated, the open time of the intake passage can be controlled by the position of the throttle member. In some applications, the rotary valve member itself can function as the throttle member. A plurality of similar valve assemblies can be positioned adjacent to one another and concatenated so that they all operate in unison to control the working fluid flow to and from all the cylinders of a multi-cylinder engine. The assembly is particularly suitable for converting an internal combustion engine so that it operates under steam power. Other applications for the assembly are also disclosed.

19 Claims, 8 Drawing Sheets

U.S. PATENT DOCUMENTS 4,479,512 10/1984 Ohrendorf et al. ..... 137/625.17
4,817,374 4/1989 Kitta ..... 137/595 X
4,881,574 11/1989 Olson et al. .
4,944,261 7/1990 Coates .
4,953,527 9/1990 Coates .
4,976,232 12/1990 Coates .
4,989,558 2/1991 Coates .
4,989,576 2/1991 Coates .
5,109,814 5/1992 Coates .
5,242,150 9/1993 Shiffler et al. ..... 251/209
5,251,591 10/1993 Corrin .
5,251,665 10/1993 Schaufeld ..... 137/595 X
5,308,040 5/1994 Torres .
5,524,822 6/1996 Simmons ..... 137/625.17 X
5,558,049 9/1996 Dubose .
5,623,901 4/1997 Hartzell .
5,718,198 2/1998 Adamisin et al. .
5,901,943 5/1999 Tsunoda ..... 251/294
5,911,203 6/1999 Lambert et al. ..... 123/80 D
5,979,492 11/1999 Miller ..... 251/209 X
6,029,617 2/2000 Lambert et al. ..... 123/80 D

ROTARY VALVE ASSEMBLY FOR ENGINES AND OTHER APPLICATIONS

RELATED APPLICATION

This application is a continuation-in-part of Ser. No. 09/076,287, filed May 12, 1998, now U.S. Pat. No. 5,911,203 and of Ser. No. 09/236,774, filed Jan. 26, 1999, now U.S. Pat. No. 6,029,617.

BACKGROUND OF THE INVENTION

This invention relates to a modular rotary valve assembly for controlling the flow of a working fluid to and from the cylinder of an engine or pump of the piston and cylinder type or to regulate fluid flow generally.

In an engine of the piston and cylinder type, it is necessary to charge each cylinder with a working fluid during the intake part of the engine cycle and to vent the fluid from the cylinder during the exhaust portion of each cycle.

In the case of an internal combustion engine, the working fluid injected into the cylinder is a fuel/air mixture and the fluid exhausted from the cylinder comprises the products of combustion of that fuel/air mixture. In the case of a uniflow steam engine, the working fluid is high pressure steam which is injected into the cylinder when the cylinder is at top dead center said steam being vented from the cylinder at the bottom of the piston stroke. Counterflow steam engines exhaust the steam through exhaust valves, in the cylinder head at top dead center. In all of these engines, the flow of the working fluid to and from the engine cylinders is controlled by intake and exhaust valves which open and close at the appropriate times during each cycle of each cylinder of the engine. In conventional gasoline engines, the valves are usually spring-loaded reciprocating valves which are opened and closed by cams on a rotary cam shaft, the cam shaft being rotated by the engine's crank shaft. Such reciprocating valves require a relatively large number of moving parts such as return springs, lifters, etc. Those valves are also prone to excessive wear and usually cause appreciable noise and vibration during operation of the engine.

State of the art steam engines employ variable cut-off throttles. Older, less efficient and less responsive steam engines employ fixed cut-off throttles. Fixed cut-off engines position the throttle in a position similar to that of the carburetor in an internal combustion engine. In a fixed cut-off system, a manifold connects the throttle to the cylinders. When the intake valve closes, steam is left in the manifold. The steam in the manifold loses heat energy and pressure decreases. If the driver backs off the throttle completely causing it to close, the other cylinders remove the remaining steam from the manifold, wasting it. When the throttle is re-opened, the manifold must be re-filled with steam before the steam can enter the intake valves. Thus, leaving steam in the manifold during deceleration wastes energy.

In a variable cut-off system, the intake valves perform the throttle function. For the intake valves to meter the steam entering the cylinder, open valve time must be variable. In the past, this was accomplished by using two intake valves. Each valve was opened by a different cam. In order for steam to enter the cylinder, both valves had to be open at the same time. Such a multiple valve, multiple cam arrangement is complex and lacks precision.

To address such problems, it has been proposed to employ rotary valves to control the flow of the working fluid to and from the engine cylinders. For example, U.S. Pat. No. 4,944,261 discloses a spherical rotary valve assembly for an internal combustion engine. In accordance with that teaching, each engine cylinder requires two such assemblies, one to control the flow of the fuel/air mixture to the associated cylinder and the other valve to control the exhaust of the combustion products from that cylinder. Because the moving valve member of that valve assembly is a complicated 3-dimensional part, the assembly as a whole is difficult to manufacture and therefore relatively expensive. Bearing in mind that each engine may comprise 4, 6, 8 or more cylinders, each of which requires two such valve assemblies, the implementation of that patented construction adds materially to the overall cost of a typical engine.

In other conventional engines, complicated fuel injectors are used to inject the fuel into the engine cylinders at the appropriate times.

It would be advantageous, therefore, to be able to provide a simple, low cost valve assembly which can replace the reciprocating valves or injectors on a standard gasoline or diesel engine to enable that engine to run under steam power.

SUMMARY OF THE INVENTION

Accordingly, it is an object of the present invention to provide an improved rotary valve assembly for an engine of the piston and cylinder type.

Another object of the invention is to provide a modular rotary valve assembly which can be retrofit to a conventional internal combustion engine to allow that engine to be operated under steam power.

A further object of the invention is to provide a modular rotary valve assembly of this type which can control the flow of the working fluid both to and from each engine cylinder.

Another object of the invention is to provide a rotary valve that eliminates the need for any camshaft, while enabling a controller to automatically create the effect of a racing cam when acceleration and speed are desired or a miles per gallon (mpg) cam when mileage is the priority.

Another object of the invention is to provide such a valve assembly which can be made relatively inexpensively in quantity.

A further object of the invention is to provide rotary discoid valve assembly which can be installed on a conventional engine of the piston and cylinder type with a minimum amount of time and effort.

It is another object of the invention to provide such a valve assembly which has separate utility in a pump and as a fluid control device.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, our modular rotary valve assembly may be used on an engine of the piston and cylinder type to control the flow of working fluid to and from a cylinder of that engine. If the engine has more than one cylinder, a number of such assemblies corresponding to the number of cylinders in the particular engine may be concatenated and driven in unison by the engine's crank shaft. The valve assembly has particular application to the conversion of an internal combustion engine to an engine which uses steam as the working fluid to drive the pistons. However, as we shall see, the assembly may also be used to control the flow of fluid to and from a pump and to regulate fluid flow generally.

The valve assembly comprises a housing which may be mounted to the top of a standard engine block. The housing is formed with a cavity over each engine cylinder shaped to snugly receive a rotary valve member, e.g., in the form of a disc or cylinder. The valve member has an axle or shaft which is journalled in the housing so that when the module is installed on the engine block, the axle may be coupled for rotation with the engine crank shaft. Also formed in the housing are an intake passage and an exhaust passage, each such passage being interrupted by the housing cavity containing the rotary valve member. The intake passage extends from a port at the top or a side of the housing to a port at the underside of the housing. The exhaust passage extends from a port at the underside of the housing to a port at the top or a side of the housing. The two ports at the underside of housing are spaced apart and open into the top of an engine cylinder when that module is mounted to the engine block.

The port at the entrance end of the intake passage is adapted to be connected to a source of working fluid such as high pressure steam and the port at the exit end of the exhaust passage as adapted to be connected to a suitable exhaust manifold.

As noted previously, the intake and exhaust passages are interrupted by the cavity in the manifold housing. Consequently, when the valve member is mounted for rotary motion within that cavity, it intercepts the intake and exhaust passages.

In accordance with the invention, the valve member is formed with a specially shaped open window which occupies a selected sector of the valve member and whose size may vary with increasing distance from the rotary axis of the valve member and/or angular position on the member and/or axial position along the valve member. Accordingly, when the valve member is rotated to position the window opposite the intake or exhaust passage, fluid is free to flow from the inlet end of that passage to the outlet end thereof. On the other hand, when the solid portion of the valve member intercepts the intake or exhaust passage, fluid cannot flow through that passage. Thus, rotation of the valve member, for example at crank shaft speed, periodically opens and closes the intake and exhaust passages alternately.

Further in accordance with the invention, the assembly includes means for varying the open time of the intake passage. More particularly, throttle means, e.g., a linear or rotary control member in the form of a throttle bar or throttle disk or the valve member itself, may be movably mounted in the housing relative to the intake passage or the valve member window. The throttle means are movable toward and away from, around or along the rotary axis of that member. Furthermore, a through hole is provided in the throttle means which hole may be an extension of the valve member window, In any event, the hole may open to the intake passage at some or all positions of the throttle means.

Thus, the throttle means may be moved to a first position wherein the hole therein is located relative to the valve member window or the intake passage so that when the valve member is rotated to position the valve member window opposite the intake passage, the throttle means hole may be located opposite a relatively large area of the intake passage or valve member window. Therefore, steam will flow through the intake passage into the associated engine cylinder for a relatively long time. On the other hand, when the throttle means are moved to a second position, the hole therein may be located differently relative to the intake passage or the valve member window. Consequently, when the window in the valve member is rotated opposite the intake passage, the hole in the throttle means may lie opposite a smaller area of the intake passage or the valve member window. Resultantly, less steam will flow to the engine cylinder. Intermediate settings of the throttle means may vary the open time of the intake passage between those two extremes. Thus, the amount of steam introduced into each engine cylinder during each cycle, and so too engine speed and power, will vary depending upon the position of the throttle means in each valve assembly.

Also, as will be described in detail later, the setting of the throttle means will also affect the phase angles at which the rotary valve member will open and close the intake passage (and perhaps also the exhaust passage) of the valve assembly.

As noted above, in one assembly embodiment, the rotary valve member itself may be movable axially relative to the intake passage and function also as the throttle means, an extension of the valve member window constituting the hole in the throttle means.

In a reverse application, the valve assembly may operate in more or less the same way to control the fluid flow to and from the cylinder of a piston pump with the rotation of the valve member again being coordinated with the reciprocating or rotating action of the piston.

In a more general application, a valve assembly with a single passage and throttle means controlling fluid flow therethrough may be used in a variety of different situations to automatically regulate fluid flow so that it follows a selected flow profile over time.

BRIEF DESCRIPTION OF THE DRAWINGS

For a fuller understanding of the nature and objects of the invention, reference should be had to the following detailed description taken in connection with the accompanying drawings, in which.

DETAILED DESCRIPTION OF ILLUSTRATIVE EMBODIMENTS

In the present application, we will describe our valve assembly used to convert a more or less conventional internal combustion engine so that that engine can operate under steam power. As noted above however, our assembly also has application to control the flow of a working fluid generally so that the fluid has a selected profile over time.

Figure 1:
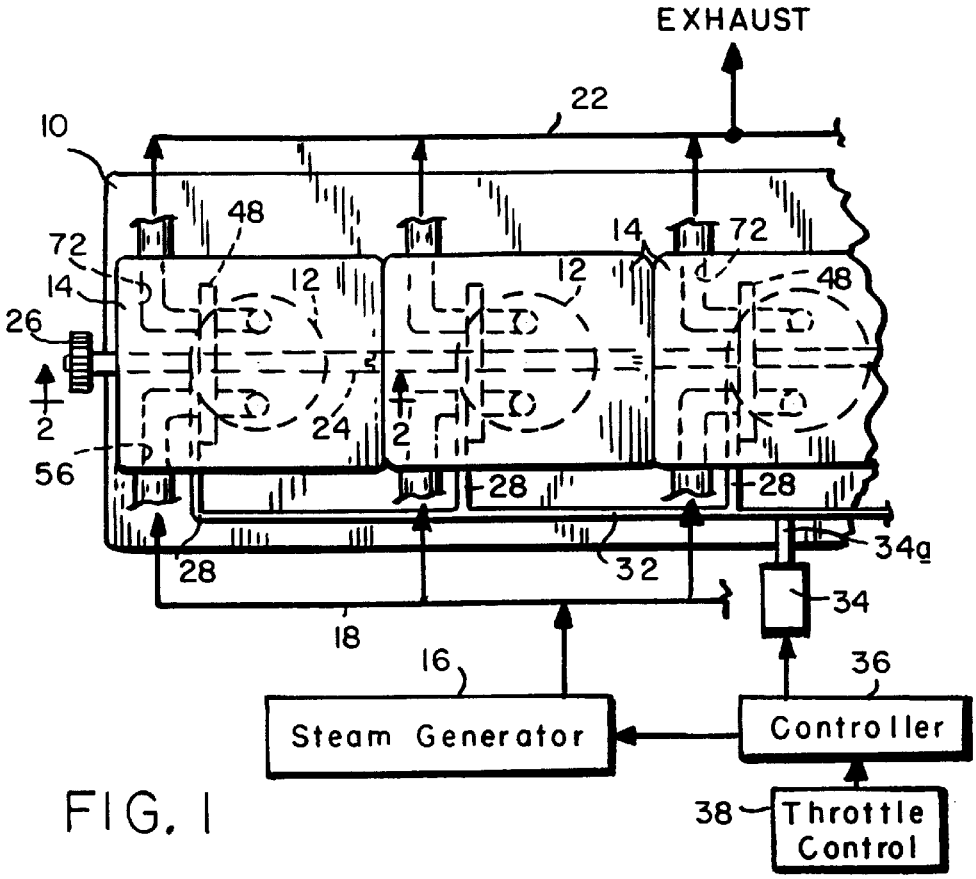
FIG. 1 is a fragmentary plan view with parts shown diagrammatically of a steam engine incorporating modular rotary discoid valve assemblies according to the invention.

Refer now to FIG. 1 of the drawings which shows an internal combustion engine 10 having cylinders 12. Only two such cylinders 12 are shown; a typical engine may have 4, 6, 8 or more such cylinders. The head of the engine 10 containing the usual reciprocating valves, valve lifters, etc., has been removed and replaced by modular rotary discoid valve assemblies 14 incorporating the invention. Two complete assemblies are illustrated in FIG. 1. Actually, the number of assemblies 14 will correspond with the number of cylinders in the particular engine.

High pressure steam from a steam generator 16 is supplied via an intake manifold 18 to each valve assembly 14. Each valve assembly 14 is designed to deliver that steam to the corresponding cylinder 12 during the intake portion of the cylinder cycle and to exhaust said steam from that cylinder during the exhaust portion of that cycle. That exhausting steam is vented to the atmosphere through an exhaust manifold 22 connected to each assembly 14.

Figure 10:
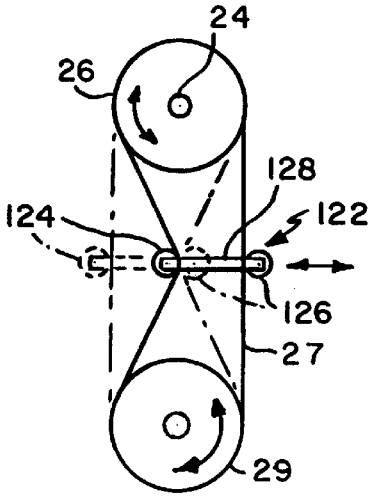
FIG. 10 is a diagrammatic view showing a phase controller for the illustrated valve assemblies.

The operation of the valve assemblies 14 is coordinated with the operation of the engine and more particularly with the positions of the pistons 23 (FIG. 2) in the engine cylinders 12. For this, each assembly 14 includes a rotary shaft or axle 24. As best seen in FIGS. 1 and 10, pulley 26 is mounted to the leading end of the shaft 24 in the first or leading assembly 14 or engine 10 and that pulley is connected via a suitable timing chain or belt 27 (FIG. 10) to the pulley 29 on the crank shaft 30 of the engine 10. All of the assemblies 14 are mounted in a row on engine 10 such that the shaft of each assembly (except the first) is fixed to rotate with the shaft of the assembly in front of it. More particularly, in FIG. 1 the leading end of each of those shafts is keyed to the trailing end of the shaft of the assembly to the left of it so that when the pulley 26 is rotated, the shafts 24 of all of the assemblies 14 will rotate in unison.

In accordance with the invention, each assembly 14 also includes throttle means which may in the form of a throttle bar 28 for controlling the amount of steam entering the corresponding cylinder 12 during the intake portion of each engine cylinder. All of the throttle bars 28 are connected by a link 32 to the movable shaft 34*a* of a linear actuator 34. The actuator 34 is controlled by signals from a controller 36. Controller 36 responds to commands from a throttle control 38 which may, for example, include a pedal depressed by the engine operator's foot. Those commands cause controller 36 to operate actuator 34 to shift the throttle bar 28 so as to vary the opening and closing times of the valve assemblies 14 as will be described presently.

Figure 4:
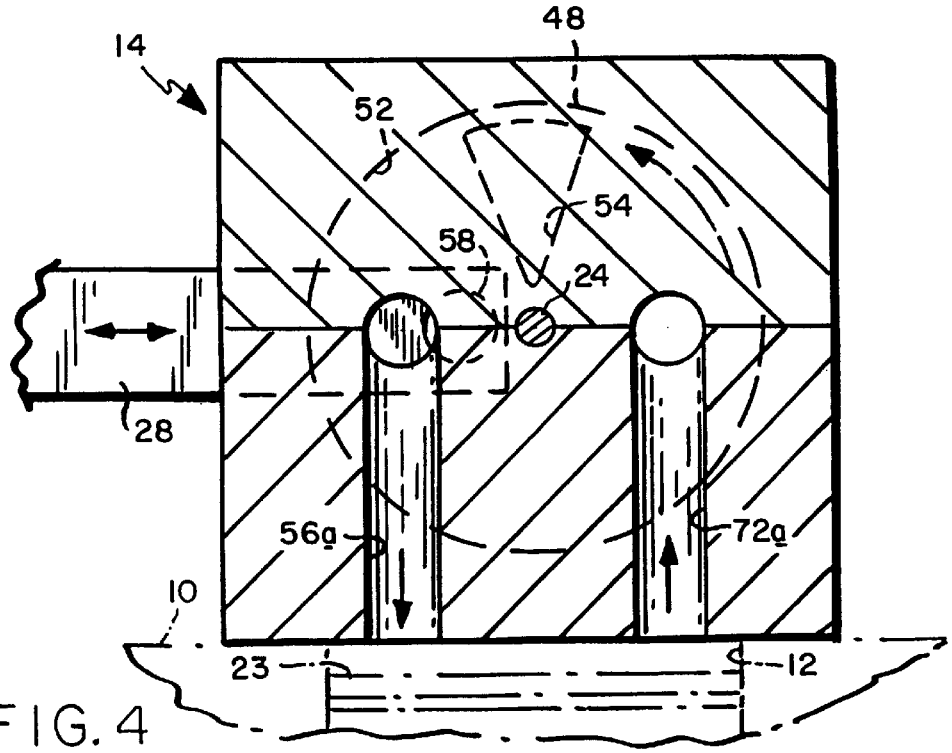
FIG. 4, is a sectional view taken along line 4—4 of FIG. 3.
Figure 2:
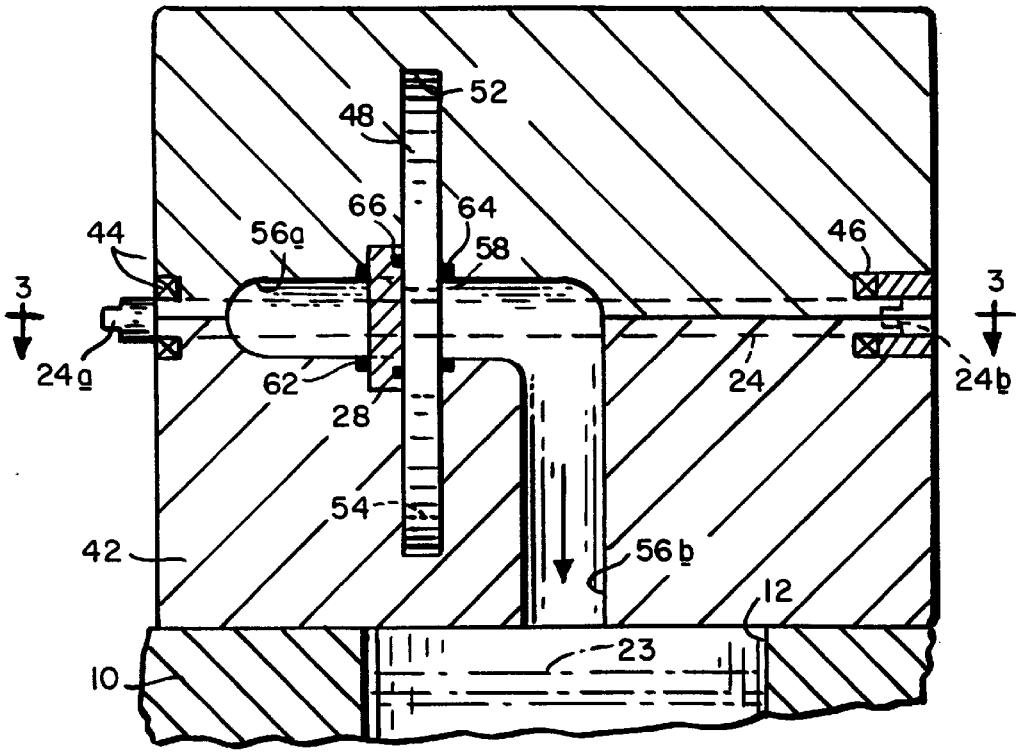
FIG. 2 is a sectional view on a larger scale taken along line 2—2 of FIG. 1.
Figure 3:
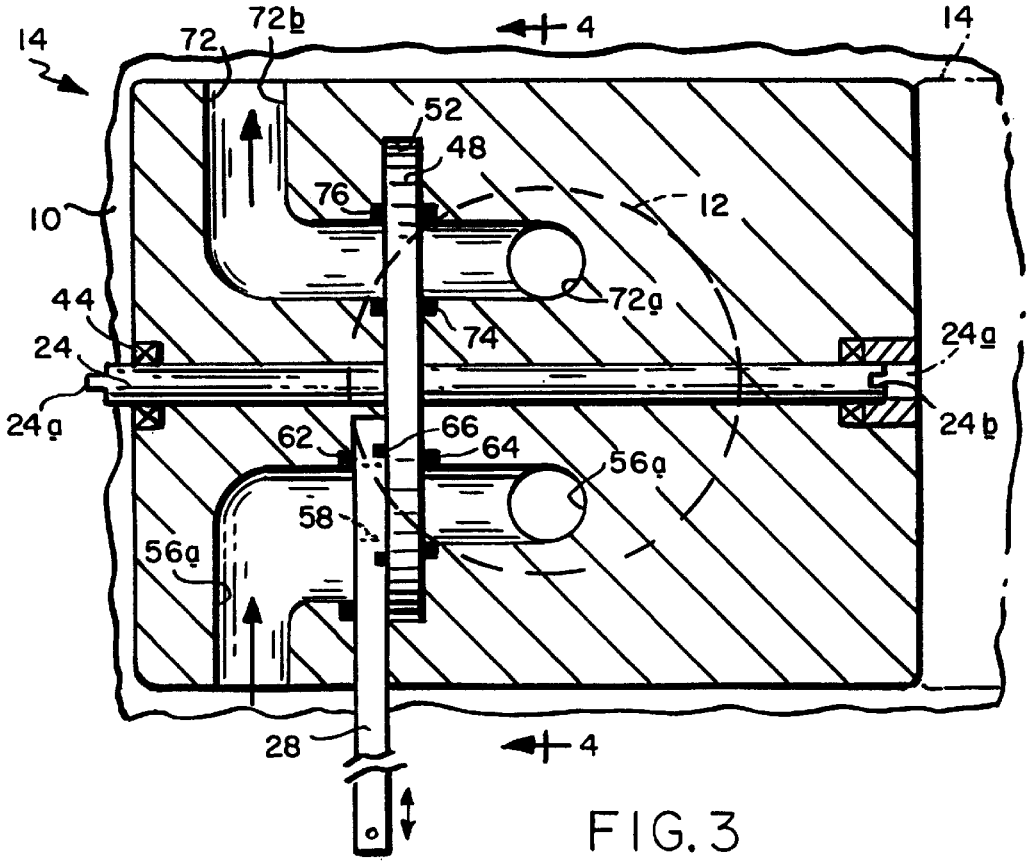
FIG. 3 is a sectional view taken along line 3—3 of FIG. 2.

Referring now to FIGS. 2 to 4 of the drawings, each module 14 comprises a block-like housing 42. A shaft 24 extends fore and aft within housing 42 and is rotatably supported in the housing by fore and aft bearing units 44 and 46. The leading end of shaft 24 projects from the housing and is terminated by a key 24*a*. The trailing end of shaft 24 is recessed into housing 42 and is formed with a slot 24*b*. Thus, when two assemblies 14 are positioned next to another as shown in FIG. 3, their shafts can be keyed together so that the shafts rotate in unison as described above.

The shaft 24 of each assembly 14 carries a valve member 48, preferably in the form of a plate or a disc, which rotates about its axis within a narrow cavity 52 in housing 42. As best seen in FIG. 4, valve member 48 is formed with a specially shaped open window 54 which occupies a selected sector of the valve member. While the specific window 54 is shown as being triangular, it may have some other shape which will allow the valve assembly to operate in the manner to be described. In general, the window has a size which varies with increasing distance from the valve member axis and/or angular position on that member.

Still referring to FIGS. 2 to 4, the valve assembly 14 includes an intake passage 56 which extends from the side of housing 42 facing intake manifold 18 (FIG. 1) to which it is connected down to the bottom of housing 42 where the passage opens into the cylinder 12 underlying that housing 42. The intake passage 56 includes an inlet side 56*a* on one side of disc 48, i.e., the left hand side in FIG. 3 and outlet side 56*b* on the opposite side of the disc. In other words, the two sides of passage 56 extend to the housing cavity 52 such that the passage 56 is intercepted by housing cavity 52 and the discoid valve member 48 therein.

Also, the throttle bar 28 is movably mounted in housing 42 between the inner end of the inlet passage section 56*a* and disc 48, the bar 28 facing the disc and being slidable in the housing radially along the disc. As shown in FIG. 3, a through hole 58 is provided adjacent the inner end of throttle bar 28 so that steam can flow from the intake passage section 56*a* to the valve member 48. More particularly, as the throttle bar is moved in and out, the incoming steam will be conducted to different radial areas of the discoid valve member 48. Thus, if the valve member 48 is rotated to position its window 54 opposite the intake passage 56, steam will be conducted from the intake passage section 56*a* through the hole 58 in the throttle bar 28 through the valve member window 54 to the intake passage section 56*b* and thence to cylinder 12. On the other hand, when the discoid valve member 48 is rotated to position a solid portion of the valve member opposite passage 56, no steam can flow to passage section 56*b* and thence to cylinder 12. As will be described in more detail later, depending upon the position of the throttle bar 28, the hole 58 in the throttle bar will overlap different portions of the window 54 in the valve member 48. This will effect the phase angles at which the intake passage 56 is opened and closed by the rotary valve member 48 and thus the open time of that passage.

As best seen in FIGS. 2 and 3, sliding seals 62 and 64 are provided at the inner ends of the passage sections 56*a* and 56*b*, respectively, to minimize steam leakage at those locations. A similar sliding seal 66 is provided around the throttle bar opening 58 to minimize leakage between the throttle bar and the valve member 48.

It is also important to note from FIG. 3 that the inner end of the passage section 56*a* is elongated in the sliding direction of the throttle bar 28 so that the inner end of intake passage section 56*a* will open into the hole 58 in the throttle bar at all positions of the throttle bar.

Still referring to FIGS. 2 to 4, the valve assembly also includes an exhaust passage 72 extending from the bottom of housing 42 facing cylinder 12 to the side of housing 42 facing the exhaust manifold 22 (FIG. 1). Passage 72 includes an inlet section 72*a* on one side, e.g., the right side, of valve member 48 and an outlet section 72*b* on the other, i.e., left, side of the valve member. The inner ends of both exhaust passage sections open into the housing cavity 52 such that the passage can be occluded by the rotary valve member 48. Preferably, sliding seals 74 and 76 are provided at the inner ends of those passage sections to minimize leakage at the boundaries between those passage sections and the rotary valve member 48.

Figure 5A:
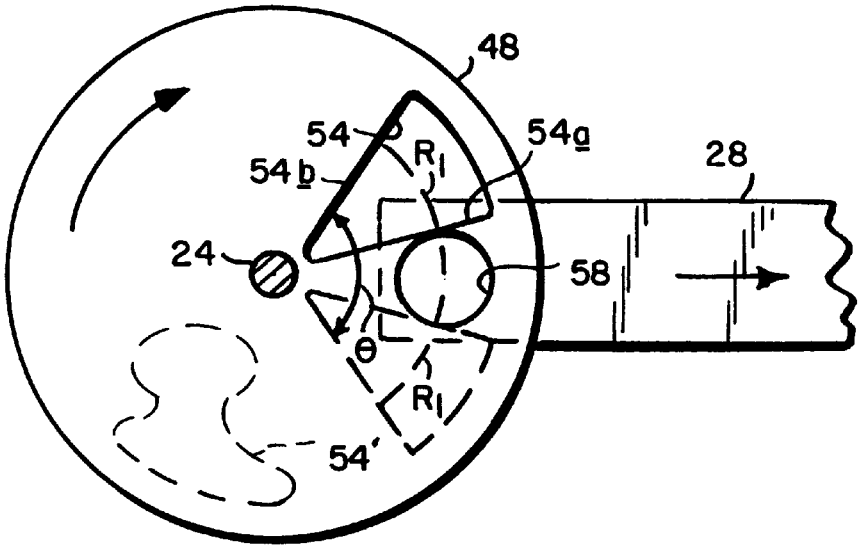
FIGS. 5A and 5B are diagrammatic views illustrating the operation of the valve assembly.
Figure 5B:
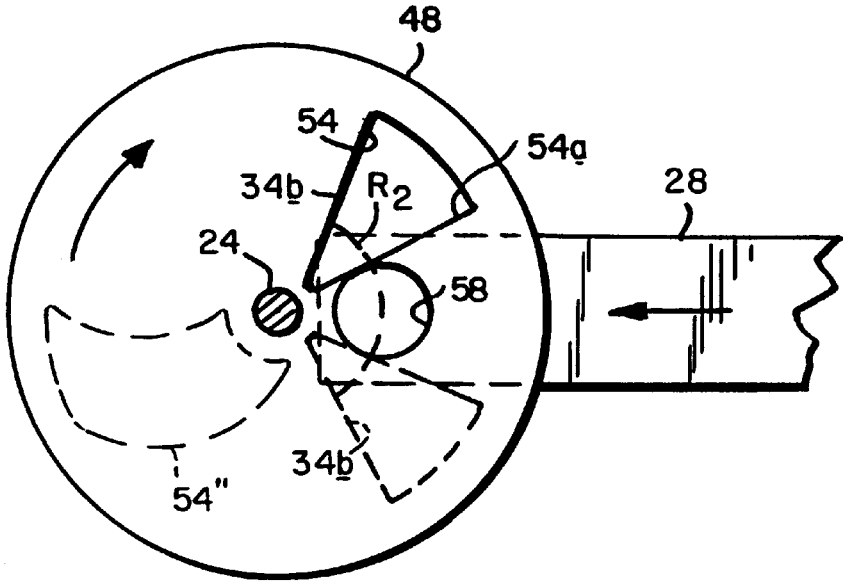

When the engine 10 is in operation, the valve member 48 of each valve assembly will rotate in the direction of the arrow in FIGS. 4, 5A and 5B in synchronism with the engine crank shaft which reciprocates all of the pistons 23 in cylinders 12. Resultantly, the window 54 in the valve member will be rotated alternately opposite the intake passage 56 and the exhaust passage 72 thereby alternately opening and closing those passages in a periodic manner so that high-pressure steam can flow into cylinder 12 when the piston in that cylinder is at top dead center and be exhausted from that cylinder when the piston is at or near the bottom of its stroke.

In accordance with the invention, the operator can control the speed and power of engine 10 by appropriately actuating the throttle control 38. Movement of the throttle control in one direction will cause controller 36 to control actuator 34 so that the actuator shaft 34*a* is advanced. Movement of the throttle control in the opposite direction will cause the actuator shaft 34*a* to retract. Those motions of the actuator shaft are transferred by linkage 32 to the throttle bar 28 of each valve assembly 14.

As best seen in FIG. 5A, when the throttle bar 28 of a valve assembly 14 is fully retracted, the hole 58 in the throttle bar 28 is located relatively far away from the axis of the discoid valve member 48, i.e., at a center distance $R_1$ where the window 54 is widest. Consequently, as the valve member 48 rotates in the direction of the arrow, the window 54 in the valve member will overlap the throttle bar opening 58 for a relative long period of time so that a relatively large volume of high-pressure steam can flow through the intake passage 56 to the cylinder 12 sufficient to drive the piston in that cylinder all the way to the bottom of its stroke. In other words, steam will begin to flow into the cylinder as soon as the leading edge 54*a* of the window 54 passes the upper edge of the throttle bar hole 58. The flow of steam will increase during the time the window 54 is directly opposite opening 58 and will decrease as the trailing edge 54*b* of the window approaches the lower edge of hole 58. Thus, at least some steam will flow to the cylinder while member 48 rotates through angle θ in FIG. 5A. During the rest of each revolution of member 48, the intake passage 56 will be occluded by the solid area of valve member 48 so that no steam can flow into cylinder 12.

On the other hand, when the throttle bar 28 is in its fully extended position, its hole 58 will lie relatively close to the axis of the valve member 48, i.e., at center distance $R_2$. Therefore, as the valve member 48 is rotated, the throttle bar hole 58 will overlap the narrower, radially inner end of window 54. Resultantly, steam will flow through the intake passage 56 to cylinder 12 for a relatively short period of time. As a consequence, the volume of steam introduced into cylinder 12 may only drive the piston 23 in that cylinder a relatively short distance toward the bottom of its stroke. Therefore, the cylinder will contribute minimum torque to the engine crank shaft which will thereupon operate at a relatively low speed and power. Of course, intermediate positions of the throttle bar 28 will result in intermediate volumes of steam being introduced into the cylinder 12.

As the setting of the throttle bar 28 affects the open time of the intake passage 56, it also affects the phase angle of the valving action in that passage. In other words, when the throttle bar 28 is in its fully retracted position in FIG. 5A, steam will flow through the intake passage to the cylinder sooner than is the case when the throttle bar is in its fully extended position as in FIG. 5B, thus affecting engine timing to some extent. This is advantageous because under certain load and rpm conditions, advancing or retarding the inlet and/or exhaust valves enhances efficiency, power or torque although not necessarily at the same time.

In a counterflow steam engine, shutting the exhaust valve early (i.e. before top dead center) may conserve energy by using what would be exhausted steam to pressurize the cylinder prior to opening the intake valve. Therefore, less additional steam is needed to create sufficient pressure to push the pistons down at the desired speed. Similarly, at high rpm, the intake valve remains open for a very short time. Opening the valve early (before TDC) allows the intake valve to stay open longer, permitting more steam to enter the cylinder, creating higher pressure.

Of course, during a later portion of the cylinder cycle when the intake passage 56 is occluded and the window 54 is positioned so that it overlaps the exhaust passage 72, the now low pressure steam in cylinder 12 will be vented to the atmosphere or a condenser via that passage for the duration of that overlap. Thus, steam will enter and leave the cylinder periodically with the amount of steam varying depending upon the setting of the throttle bar 28. The relative angular positions of the windows 54 on the valve member 48 in the various valve assemblies 14 may be the same or may be offset from one another to achieve optimum engine performance.

FIGS. 5A and 5B also illustrates the operation of our valve assembly as used to control fluid flowing periodically through a single passage intercepted by the rotary valve member 48, the amount of flow being controlled by throttle bar 28. Depending upon the particular application, the window 54 in valve member 48 may have a variety of different shapes as indicated by the free form window shown in phantom at 54' in FIG. 5A and/or its angular location on the valve member 48 may vary with increasing distance from shaft 24 as shown in phantom at 54" in FIG. 5B, or the window may have both of these characteristics. In some cases, the valve member may have more than one window; see 54 and 54' in FIG. 5A. In all cases, the objective is to achieve a selected flow profile through a flow passage over time. To facilitate reaching this objective, the movements of the valve member 48 and the throttle bar 28 may be coordinated by a suitably programmed controller similar to controller 36 in FIG. 1.

A valve assembly incorporating our invention may even be used as a controllable fluid mixing device. For example, the assembly may include two or more inlet conduits on one side of the rotary valve member, each equipped with a throttle bar and a corresponding number of outlet conduits on the opposite side of the valve member, with all of the outlet conduits leading to a single exit conduit. A different fluid may be introduced into each inlet conduit. As the valve member is rotated, the different fluids in the inlet conduits will be passed in turn through the window in the valve member to the outlet conduits and mixed in the exit conduit. The proportions of the different fluids in the final mix may be controlled by properly adjusting the various throttle bars in the assembly manually or automatically.

While we have specifically illustrated a valve assembly having a valve member 48 which rotates about an axis which extends fore and aft, e.g., parallel to the axis of the engine's crank shaft in FIG. 1, it should be understood that it is also possible to have member 48 rotate about an axis which is perpendicular to that axis such that in the mounted assembly, the disc lies in a generally horizontal plane thus giving the assembly a very low profile. In this event, the valve member 48 may be rotated by a fore and aft-extending shaft coupled by a bevel gear to the vertical valve member shaft or axle.

The above-described modular discoid valve member has only three main moving parts which are relatively easy to make in quantity. Both the rotary valve member 48 and the throttle bar 28 can be simple, stamped metal parts which are easy to assemble into the housing 42. The shaft 24 is also a standard part. Therefore, the cost of the assembly does not add appreciably to the overall cost of the engine 10. Moreover, because it is of such simple construction, the assembly should be able to operate for a prolonged period without maintenance.

Figure 6:
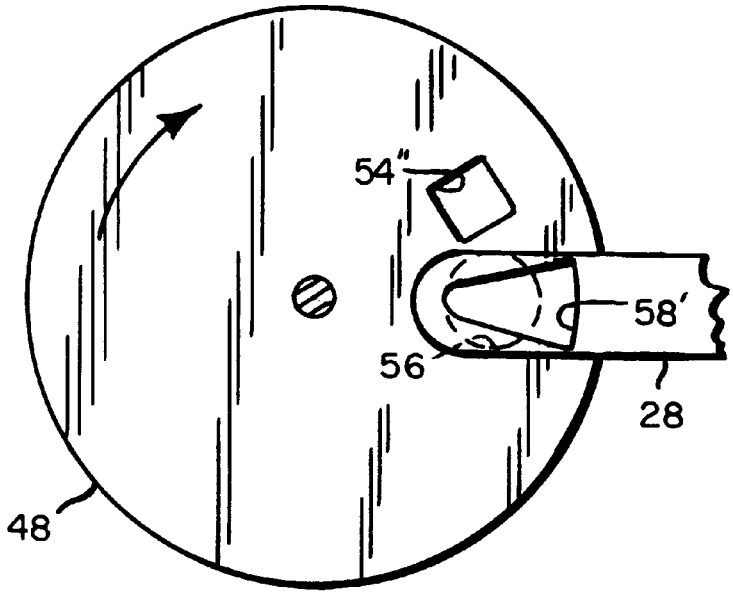
FIG. 6 is a diagrammatic view of another valve assembly embodiment.

Instead of the valve member 48 having a window whose size or shape varies relative to the rotary axis of the member as shown in FIGS. 4 and 5, the member may have a window which does not vary in those respects. Rather, the throttling effect may be achieved by having the hole in the throttle bar vary in width or shape depending upon the distance from the axis of the valve member 48. Such a valve assembly is depicted in FIG. 6. As seen there, the valve member 48 has a square window 54" and throttle bar 28 has a generally triangular hole 58'. Movement of the throttle bar 28 in and out will change the effective area of the opening into intake passage 56 when window 54" rotates opposite that passage.

Figure 7:
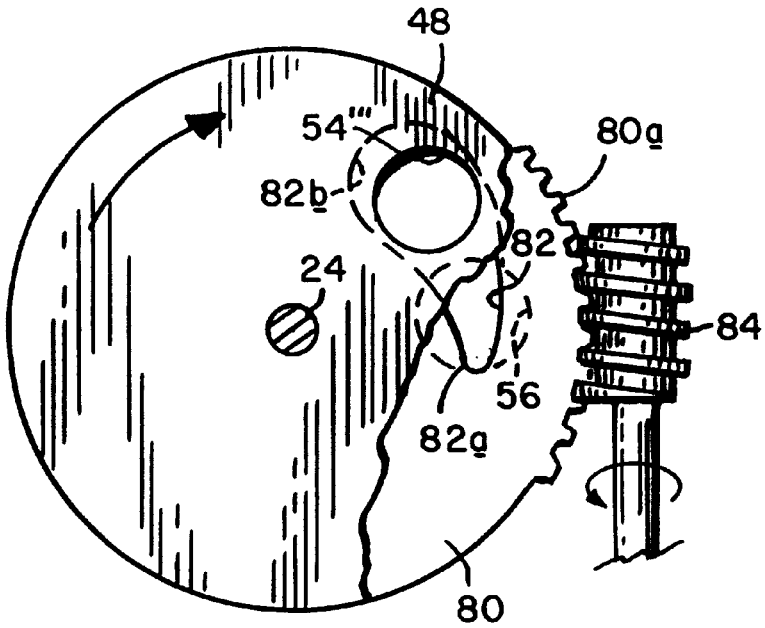
FIG. 7 is a view similar to FIG. 6 of still another embodiment of our valve assembly.

Instead of having a linear throttle means such as throttle bar 28, a rotary throttle means may be employed in the form of a throttle disc as illustrated in FIG. 7. In the valve assembly embodiment shown there, the valve member 48 has a circular window 54'" and a throttle disc 80 is positioned on shaft 24 flush against one side of valve member 48 within the housing cavity 52 as described above. Throttle disc 80 contains a hole 82 whose shape varies about the axis of the disc, the illustrated hole being wider at one end than the other. Disc 80 may be rotated relative to shaft 24 (and member 48) between a first angle which positions the narrow end 82*a* of hole 82 opposite the intake passage 56 and a second angle which positions the wider end 82*b* of hole 82 opposite passage 56. Thus, when the valve member 48 rotates to position its window 54'" opposite intake passage 56, different amounts of steam will pass through the window depending upon the angular position or phase of throttle disc 80.

Disc 80 may be moved between its two extreme positions by rotating a worm 84 which meshes with a gear track 80*a* at the periphery of disc 80.

Figure 8:
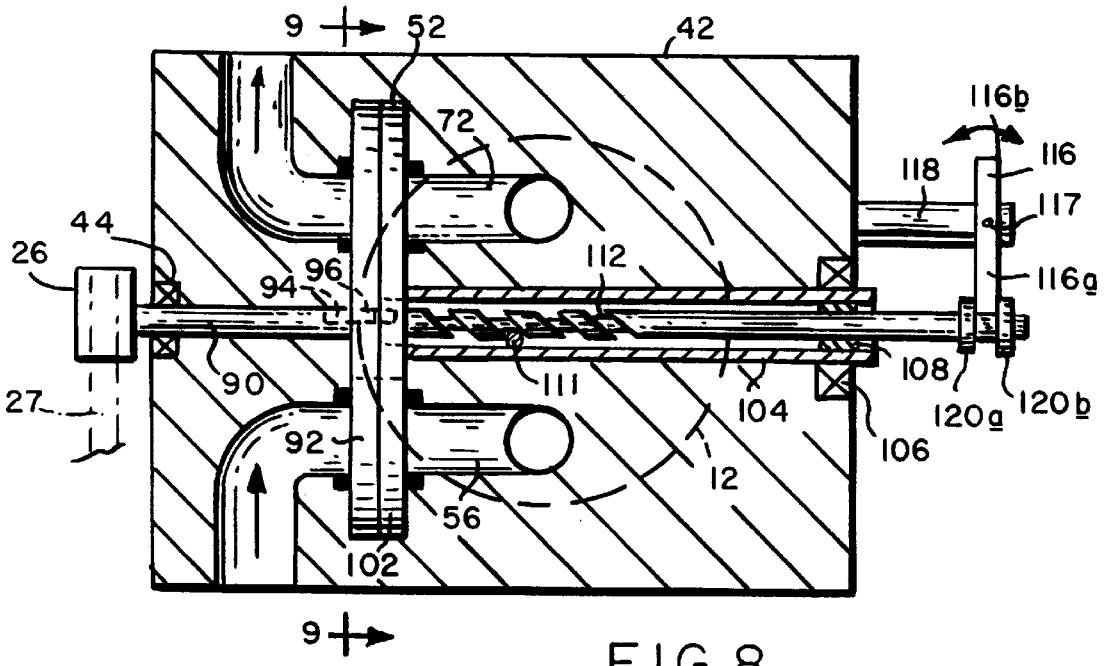
FIG. 8 is a view similar to FIG. 3 of a further valve assembly embodiment.
Figure 9:
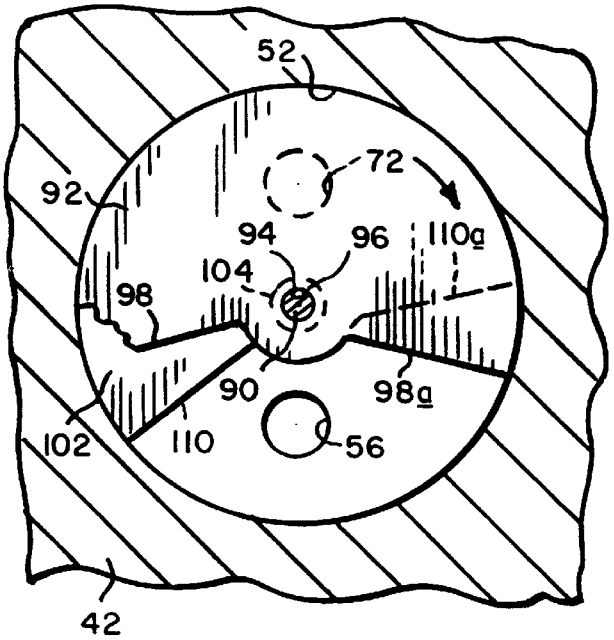
FIG. 9 is a sectional view taken along line 9—9 of FIG. 8.

Turn now to FIGS. 8 and 9 which illustrate yet another valve assembly embodiment. FIG. 8 is similar to FIG. 3 and similar parts carry the same numeric identifiers as in FIG. 3. This assembly embodiment has a shaft 90 rotatably mounted in housing 42. Fixed to rotate with shaft 90 within the housing cavity 52 is a rotary valve member 92. In this case, however, the shaft 90 is slidable within housing 42 relative to the valve member 92. For this, the shaft 90 contains a longitudinal keyway 94 which receives a key 96 extending radially inward from disc 92.

As best seen in FIG. 9, the valve member 92 has a window 98 which corresponds to a relatively large sector of the valve member. For example, the window may be 130 to 160 degrees and extend out to the periphery of the valve member. When the valve member 92 is rotated, the valve member periodically opens and closes the intake passage 56 and the exhaust passage 72 in succession.

This embodiment, like the one shown in FIG. 7, has a throttle means in the form of a rotary disc 102 positioned flush against the valve member 92 within the housing cavity 52. Disc 102 is fixed to rotate with a tubular shaft 104 which is coaxial to shaft 90 and rotatably mounted in housing 42. A bearing 106 is provided between the housing and shaft 104 to enable that shaft to rotate relative to the housing and a second bearing 108 is provided between shaft 104 and shaft 90 to allow shaft 104 to rotate relative to shaft 90.

The throttle disc 98 contains a hole 110 which replaces a relatively large, e.g., 130 to 160 degrees, sector of disc 102. In this, it is similar to the window 98 in the valve member 92. In fact, those two openings may have the same size and shape as shown in FIG. 9.

In accordance with the invention, the throttle disc 102 normally rotates with the valve member 92. However, provision is made for varying the angular position or phase of disc 102 relative to valve member 92. More particularly, the tubular shaft 104 is provided within an internal nub or boss 111 which is received in a helical groove 112 inscribed on shaft 90 opposite nub 111. As discussed above, shaft 90 is not only rotatable but slidable within housing 42. When shaft 90 is set at a selected axial position within the housing it fixes the position of nub 111 along groove 112 so that the shaft 104 is rotatably locked to shaft 90. Therefore, when shaft 90 is rotated, the valve member 92 and throttle disc 192 rotate in unison.

However, when shaft 90 is shifted axially, the engagement of nub 111 in groove 112 causes a change of angular position or phase of disc 102 relative to the throttle disc 92.

Referring to FIG. 8, shaft 90 may be shifted axially by means of a lever arm 116 connected by pivot 117 to a bracket 118 extending from the rear end of housing 42. One end 116*a* of lever arm 116 extends between a pair of collars 120*a* and 120*b* formed at the rear end of shaft 90. Movement of the opposite end 116*b* of the lever arm in one direction or the other causes an axial shift of shaft 90 in one direction or the other. Only a relatively small axial shift of shaft 90 is needed to change the phase angle of throttle disc 102 by a few degrees. To accommodate the axial shift of shaft 90, the pulley 26 at the front end of the shaft is made extra thick or deep so that it can shift axially without upsetting its connection to the timing chain or belt 27.

When shaft 90 is rotated clockwise, the valve member 92 will periodically first open and then close intake passage 56 (and then exhaust passage 72). Shaft 90 may be positioned axially at one position so as to align the hole 110 in the throttle disc 102 with the window 98 in valve member 92. In that event, intake passage 56 (and exhaust passage 72) will remain open for a relatively long time during each revolution of the valve member. On the other hand, shaft 90 may be shifted to another position shown in FIG. 9 in which disc 102 is shifted angularly relative to valve member 92 (while still rotating therewith) so that the leading edge 110*a* of hole 110 lags the leading edge 98*a* of window 98. With this setting, intake passage 56 (and exhaust passage 72) is open for a shorter period of time during each revolution of the valve member. Also, the passage opens sooner in the cylinder cycle. In another setting of the throttle disc, its leading end 110*a* may lead the valve member edge 98*a* in which case the opening into passage 56 (and 72) may close sooner in the cylinder cycle. In other words, the valve member 92 opens and closes the steam flow through the intake passage 56 while the throttle disc 102 opens and closes entry into that passage either exactly with the valve member for long duration steam supply to cylinder 12 or ahead or behind the valve member for short duration steam supply to the cylinder. Intermediate supply durations are possible by shifting the throttle disc 102 over a typical phase angle range of, say, 30 degrees.

The valve member 92 and throttle disc 102 also open and close the exhaust passage 72 in the same way to control the steam exhaust from cylinder 12. If separate control of the steam exhaust is desired, separate valve assemblies may be used.

Figure 11:
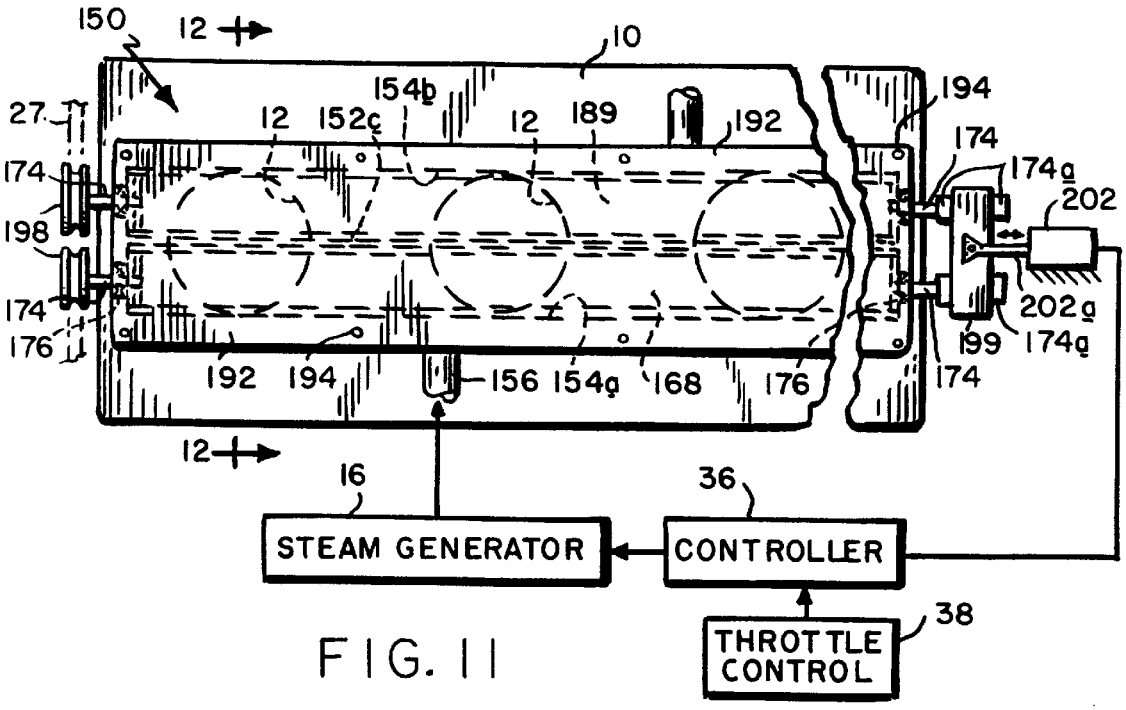
FIG. 11 is a view similar to FIG. 1 showing an engine incorporating another valve assembly embodiment.

Refer now to FIGS. 11 to 14 which show still another embodiment of our valve assembly which employs a cylinder instead of a disc as the rotary valve member. FIG. 11 shows a valve assembly capable of controlling both the steam intake and exhaust from a series of cylinders of a steam engine similar to the one depicted in FIG. 1. The components of the FIG. 11 engine that are the same as those of the FIG. 1 engine carry the same numeric identifiers.

Figure 12:
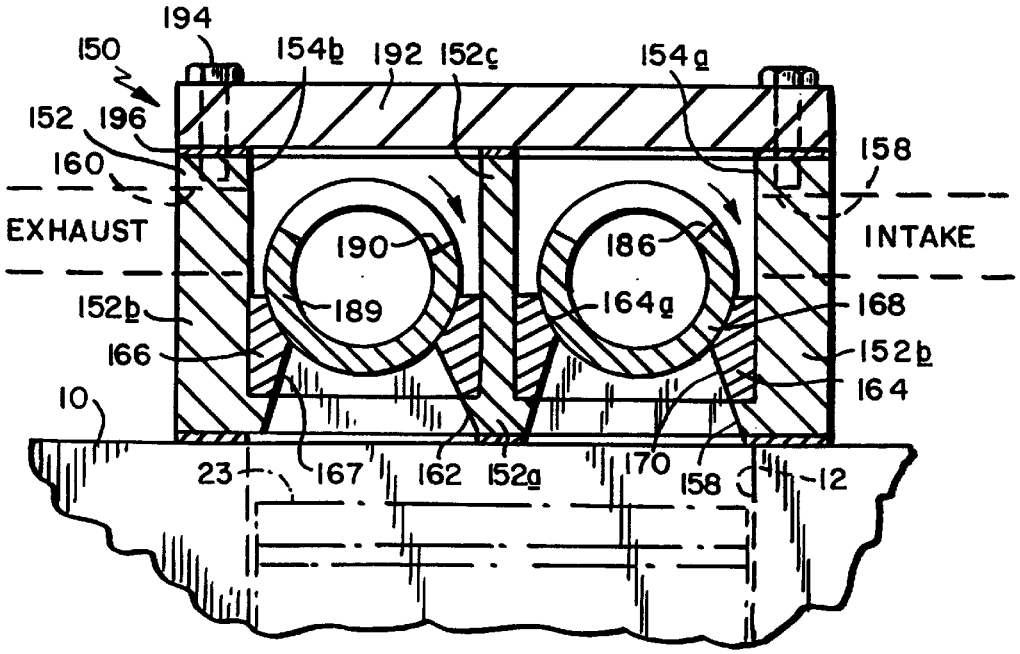
FIG. 12 is a sectional view taken along line 12—12 of FIG. 11.
Figure 13:
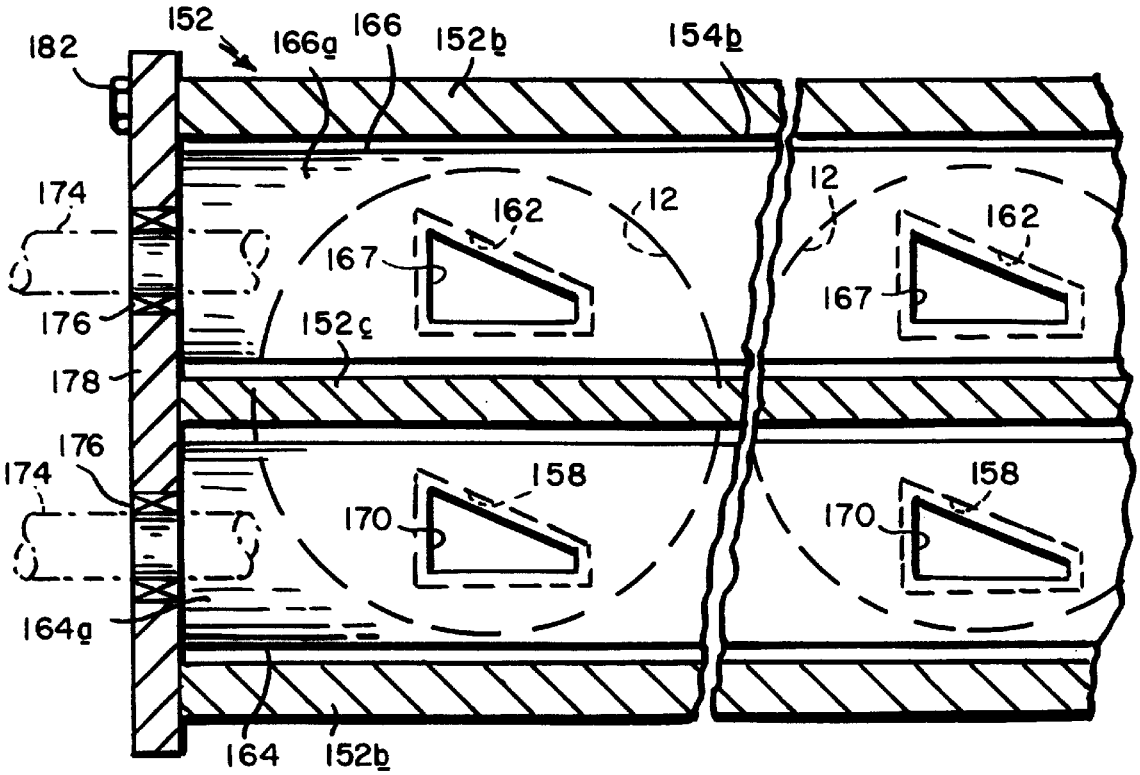
FIG. 13 is a plan view of a part of the assembly shown in FIG. 12.

This assembly shown generally at 150 is bolted to the top of the associated engine 10 which has a series of cylinders 12 slidably receiving the usual pistons 23. The assembly comprises a long, generally rectangular channel member 152 which has more or less the same length as the head of the associated engine. For example, the channel member for an eight cylinder engine ma y be in the order of 25 inches long. The width of the channel member is somewhat greater than the diameter of cylinders 12. Channel member 152 comprises a bottom wall 152*a* a pair of side wall s 152*b* and a full length partition 152*c* which divides the interior of the channel member into two longitudinal channels 154*a* and 154*b*. The side wall of channel 154*a* has an opening or part 156 which leads to the steam intake line from steam generator 16 so that the channel 154*a* can function as the engine intake manifold. As best seen in FIGS. 12 and 13, an opening 158 is provided in the channel member bottom w all 152*a* directly over each cylinder 12 to connect the interior channel 154*a* with that cylinder.

An opening or port 160 is provided in the channel member side w all 152*b* bounding channel 154*b* which vents to the atmosphere so that channel 154*b* can function as the engine's exhaust manifold. Another opening 162 is provided in the channel member bottom wall 152*a* next to each opening 158 over each cylinder 12 to connect the interior channel 154*b* with each cylinder 12 of engine 10.

Figure 14:
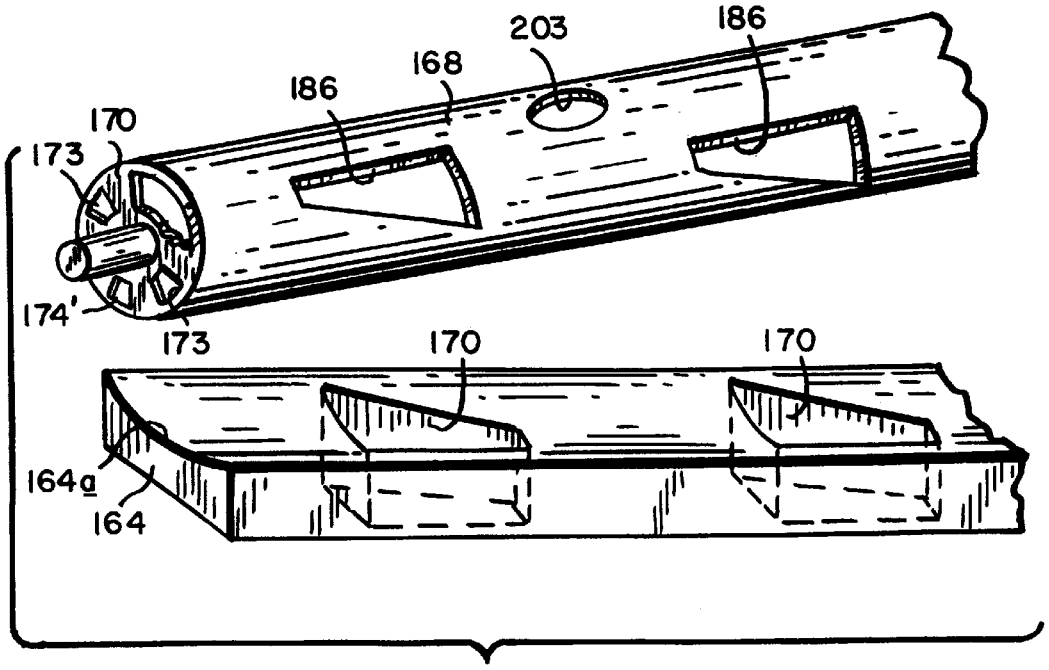
FIG. 14 is an exploded isometric view of a part of the assembly.

Present in the two channels 154*a* and 154*b* is a pair of similar, generally elongated, generally rectangular valve beds 164 and 166, respectively which may be separate parts as shown or be formed integrally with the channel member 154 bottom wall. Since the valve beds are similar, we will only describe one of those beds, namely bed 164, in detail. As shown in FIGS. 13 and 14, the upper surface 164*a* of valve bed 164 is concave in crossection with cylindrical curvature so that it can function as a valve seat for a cylindrical tubular rotary valve member 168 whose outer diameter is substantially the same as the diameter of the valve bed surface 164*a* but whose length is somewhat less than that of channels 154*a*, 154*b*. A lengthwise series of through holes 170 is provided in bed 124, one hole over each cylinder 12 of engine 10. The holes 170 are shown as being generally triangular. However, they could have some other shape. Each hole 170 along with underlying opening 158 constitutes a port into a cylinder 12.

Mounted to the opposite ends of valve member 168 is a pair of circular end plates 172 each fitted with an axial shaft 174. Preferably, large openings 173 are provided in each end plate for reasons that will become apparent. When the valve member 168 is seated on its valve bed 164, the shafts 174 project from the opposite ends of the valve bed 164. As shown in FIGS. 11 and 13, each shaft 174 is rotatably mounted by way of a bearing element 176 to an end wall 178 (only one being shown) secured to the adjacent end of channel member 152 by bolts 182 extending through end walls 178 and threaded into the corresponding end of the channel member sidewalls 152*b*. Each bearing element 176 is designed to permit both rotary motion of the associated shaft 174 and a certain amount of axial movement of that shaft for reasons that will be described later.

As best seen in FIGS. 12 and 14, a lengthwise series of windows 186 are provided in the wall of tubular valve member 168. These openings are spaced along the valve member so that when the valve member is seated in its bed 164, the member may be rotated to position valve member windows 186 opposite the holes 170 in the valve bed 164. As shown in FIG. 14, the various windows 186 along the valve member may be offset circumferentially to account for the different timing of the piston strokes in the engine.

The other valve bed 166 has two angular through holes 167 similar to holes 170 in bed 164 and the other valve member 189 is formed with windows or holes 190 similar to windows 186. That valve member is rotatably seated on its bed 166 such that the shafts at the opposite ends of that valve member are journalled in the channel member end walls 178 in the same manner as the shaft of valve member 168.

As shown in FIGS. 11 and 12, the channel member 152 includes a cover 192 which closes the tops of channels 154*a* and 154*b*. The cover may be secured to the channel member by bolts 194 extending through holes in the cover and threaded into the channel member sidewalls 152*b* at spaced apart locations along the channel member. Preferably, a suitable gasket 196 (FIG. 12) is provided between the upper edges of the channel member and the cover to provide a fluid tight seal between those two members.

As best seen in FIG. 11, shafts 174 at the front of engine 10 project through the channel member end wall 178 and are provided with pulleys 198 both of which are rotated in the same direction by a timing chain or belt 27 driven by the engine crank shaft.

The two shafts 174 at the opposite or rear end of assembly 150 also extend beyond the channel member end wall at the rear of the assembly. Each such shaft 174 is provided with a pair of axially spaced collars 174*a*. A bracket 199 is positioned between the collars of each shaft, the bracket being connected to the armature 202*a* of a linear actuator 202 controlled by controller 36. As discussed up above in connection with the FIG. 8 embodiment of the invention, the actuator 202 can shift the two valve members 168 and 189 axially relative to their respective valve beds 164 and 166, the two pulleys 198 being sufficiently thick relative to belt 127 to accommodate such axial movement of the valve members.

When the engine depicted in FIG. 11 is in operation, high pressure steam is introduced into channel 154*a*, which as noted above, functions as an intake manifold. That steam enters valve member 168 through the holes 173 in that member's end plates 170 and also through some of the angularly offset windows 186 in member 168 and also through holes 203 (FIG. 14) that may be present in the valve member wall between the cylinders 12. Each time the valve member 168 is rotated to position a window 186 therein opposite the underlying hole 170 in valve bed 164, high pressure steam is conducted to the corresponding cylinder 12 of engine 10. Otherwise, the hole 170 to that cylinder 12 is closed.

Likewise, when each window 190 of valve member 189 in channel 154*b* is rotated opposite the underlying hole 167 in bed 166, steam is exhausted from the corresponding engine cylinder 12 via valve member 189 and the holes 173 at the ends thereof to the atmosphere. Otherwise, that hole 167 is closed. Rotations of the two valve members are synchronized to the rotation of the engine crank shaft which controls the positions of the pistons 23 in cylinders 12 such that the crank shaft rotates continuously under steam power.

Figure 15A:
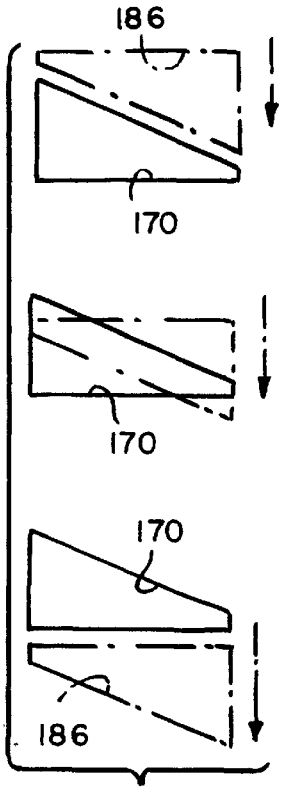
FIG. 15A to 15C are diagrammatic views illustrating the operation of the FIG. 11 assembly embodiment.
Figure 15B:
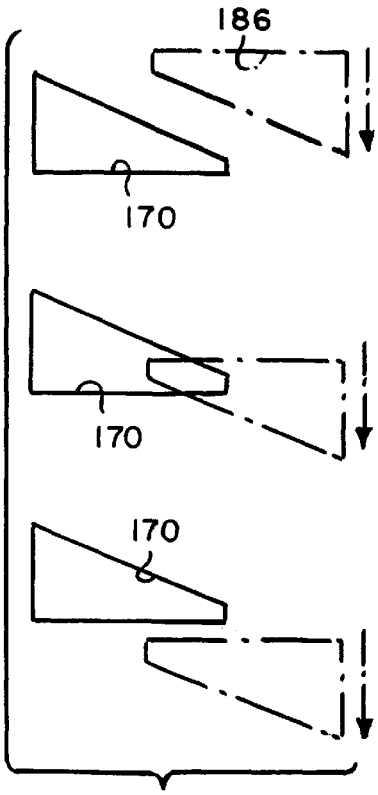
Figure 15C:
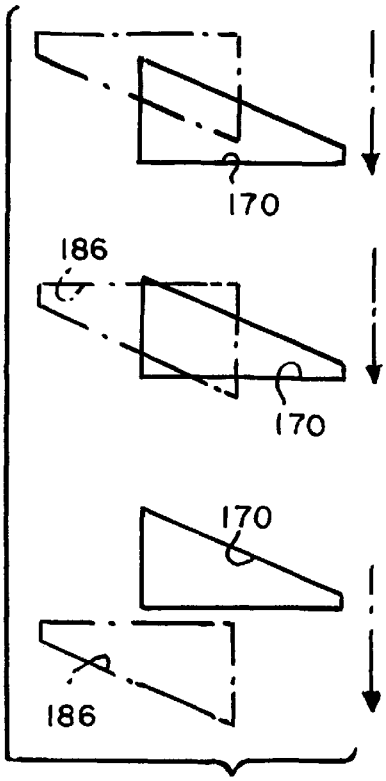

Refer now to FIGS. 15A to 15C which help to illustrate the operation of this valve assembly embodiment. FIG. 15A shows schematically one window 186 in the rotary valve member 168 relative to the underlying hole 170 in the associated valve bed 164 as the valve member rotates. As seen there, the window 186 sweeps past hole 170. Steam is conducted to the associated engine cylinder 12 only during the time that those two openings overlap. Thus, by appropriately selecting the sizes and shapes of those openings, the timings of the injection and cut-off of steam, and thus the amount of steam introduced, into cylinder 12 may be controlled.

However, as noted above, each valve member is shiftable axially. Such shifting will change the relative positions of the corresponding window 186 and hole 170. More particularly, as shown in FIG. 15B, when the valve member 168 is shifted to the right in FIG. 11 by actuator 202, a narrower portion of the rotating valve member window 186 overlaps the corresponding hole 170 in the associated valve bed. Consequently, less steam is delivered to the associated cylinder 12. By the same token, when that valve member is shifted to the left as shown in FIG. 15C, the wider end of the valve member opening 186 overlaps the wider end of the corresponding hole 170. Consequently, the two openings overlap for a longer period of time and more steam is introduced into the associated cylinder 12.

The exhaust of steam from the cylinders 12 in engine 10 is controlled in essentially the same way by the rotary valve member 189.

Thus in this valve assembly embodiment, the throttling means comprise the axially shiftable valve members themselves with a portion of each valve member window functioning as the hole in the throttling means described in connection with the FIGS. 1 to 9 assembly embodiments. This adjustable throttling capability gives valve assembly 150 all of the advantages discussed above for the other embodiments. Assembly 150 is advantaged also in that it is very simple and relatively easy to retrofit to existing internal combustion engines. Also, it is quite compact since the intake and exhaust manifolds are incorporated right into the channel member 152 of the valve assembly.

It should be understood that while the openings in the valve beds and the valve members are shown as being triangular, as with the other valve assembly embodiments described above, they could just as well have some other shape. Also, the rotary valve member and valve seat therefor need not be cylindrical. For example, if adjustable throttling is not required, they could have a conical shape. Still further, the valve member beds 164 and 166 could just as well be stationary tubes concentric to valve member 168 and 189.

While the valve assemblies described above provide control of the intake and exhaust of steam from cylinder 12, in some applications it may be desirable also to adjust the phase of the valve assembly relative to the engine crank shaft to control engine timing. FIG. 10 illustrates a simple arrangement which allows for such timing control. As shown there, the timing chain 27 which couples the valve assembly pulley 26 to the crank shaft pulley 29 may be provided with a certain amount of slack. Such slack may be taken up by a dual idler mechanism shown generally at 122. This mechanism comprises a pair of idlers 124 and 126 connected by a bracket 128. The two idlers are arranged to engage opposite stretches of the timing chain 27 looped between pulleys 26 and 29. Suitable means (not shown) are provided for shifting mechanism 122 laterally in one direction or the other. When the mechanism is shifted to the right as shown in FIG. 10, idler 124 engages and deflects the left hand stretch of the timing chain thereby shifting pulley 26 slightly counterclockwise to change the phase angle of that pulley relative to pulley 29 and the crank shaft. Likewise, shifting mechanism 122 to the left in FIG. 10 causes the idler 126 to engage and deflect the right hand stretch of the timing chain while the pulley 124 is disengaged from the timing chain. This causes pulley 26 to be rotated clockwise through a small angle thereby changing its phase angle relative to pulley 29 in the opposite direction.

A steam engine or steam engine retrofit for an internal combustion engine incorporating one or another of the valve assemblies shown in FIGS. 1 to 14 and the timing adjustment mechanism illustrated in FIG. 10 allows one to control closely the operation of the associated engine over a wide range of engine operating conditions.

It will thus be seen that the objects set forth above, among those made apparent from the preceding description, are efficiently attained. Also, certain changes may be made in the above constructions without departing from the scope of the invention. For example, a valve member 168, 189 may be solid with the window 186, 190 therein being a notch that allows the passage of fluid from cylinder 154*a*, 154*b* to hole 170, 167 when the window (notch) connects both of those spaces. Therefore, it is intended that all matter contained in the above description or shown in the accompanying drawings shall be interpreted as illustrative and not in a limiting sense.

It is also to be understood that the following claims are intended to cover all of the generic and specific features of the invention described herein.

Having described our invention what is claimed as new and secured by letters patent is:

What is claimed is:

1. A rotary valve assembly comprising a block defining a concave valve seat having cylindrical curvature about an axis, said valve seat defining a sector of 180° or less;

means defining a passage extending through said block to said valve seat;

a cylindrical valve member having a wall with an open window, the diameters of the valve seat and valve member being substantially the same;

means for rotatably mounting the valve member on said axis so that when the valve member is rotated about said axis, the valve member occludes said passage except when the window overlaps said passage, and means for moving the valve member along said axis relative to said valve seat so as to control the amount of said overlap.

2. The valve assembly defined in claim 1 and further including means for rotating said valve member about said axis.

3. The valve assembly defined in claim 1 wherein the valve member is a tube.

4. The valve assembly defined in claim 1 wherein the width of said window varies along said axis.

5. The valve assembly defined in claim 1 wherein the width or shape of said passage directly opposite the valve member varies along said axis.

6. The valve assembly defined in claim 1 wherein the window lies within a selected sector of said valve member.

7. The valve member defined in claim 1 wherein the width of said window varies along said axis.

8. A rotary valve assembly comprising a housing having a plurality of walls including a first wall and a second wall;

a first port in said first wall and a second port in said second wall;

a block defining a concave valve seat in the housing at one of said first and second walls, said valve seat extending around one of said first and second ports and having cylindrical curvature about an axis and defining a sector of 180° or less;

a cylindrical valve member supported in said housing for rotation about said axis and in contact with said valve seat, said valve member having an open window therein so positioned in the valve member that when the valve member is rotated to a first angular position, the window overlaps said one of said first and second ports whereby a working fluid can flow between said ports through said window and when the valve member is rotated to a second angular position, the valve member occludes said one of said first and second ports so that the working fluid cannot flow between said ports, and means for moving said valve member along said axis relative to said valve seat so as to adjust the amount of said overlap.

9. The valve assembly defined in claim 8 wherein the valve member has opposite ends supported by a pair of shafts rotatably mounted in the housing.

10. The valve assembly defined in claim 9 wherein the moving means comprise means for shifting one of said shafts along said axis, and further including means for rotating the other of said shafts about said axis.

11. The valve assembly defined in claim 9 and further including a second valve assembly similar to the first-mentioned valve assembly, said second valve assembly being positioned adjacent to the first-mentioned assembly, and means connecting the valve members of said first and second assemblies so that said valve members rotate in unison.

12. The valve assembly defined in claim 11 and further including means for rotating corresponding shafts of each assembly in unison so that the windows in the valve members of the assemblies are out of phase, and means for introducing a working fluid through one port of each valve assembly.

13. The valve assembly defined in claim 11 wherein the valve members of the assemblies are tubes.

14. The valve assembly defined in claim 13 wherein the shape of each window varies along the corresponding valve member axis.

15. A rotary valve assembly comprising a housing having a concave interior wall with cylindrical curvature about an axis and defining a sector of 180° or less;

a plurality of ports in said wall spaced along said axis;

a cylindrical tubular valve member supported in said housing for rotation about said axis and in contact with said interior wall, said valve member having a corresponding plurality of windows so positioned along said axis that when the valve member is rotated, the windows periodically connect the interior of the valve member with different ports in the housing interior wall.

16. The valve assembly defined in claim 15 wherein the windows in the valve member are angularly offset from one another about said axis.

17. The valve member defined in claim 15 or 16 and further including moving means for moving the valve member along said axis within the housing.

18. The valve assembly defined in claim 15 and further including means for rotating said valve member.

19. The valve assembly defined in claim 18 wherein the rotating means include a first pulley rotatably mounted to one end of the valve member;

a rotatably mounted crank shaft pulley;

a belt stretched around the first pulley and the crank shaft pulley to form a closed loop having first and second stretches extending between said pulleys so that the two pulleys rotate in unison, and means for deflecting either the first belt stretch or the second belt stretch laterally so as to change the phase angle of the first pulley relative to the crank shaft pulley.

* * * * *